US005608965A

United States Patent [19]

Kies

[11] Patent Number: 5,608,965

[45] Date of Patent: Mar. 11, 1997

[54] METHOD OF MAKING ELECTRICAL CONNECTORS

[75] Inventor: Antonius M. Kies, Oisterwijk, Netherlands

[73] Assignee: Erico International Corporation, Solon, Ohio

[21] Appl. No.: 466,464

[22] Filed: Jun. 6, 1995

[51] Int. Cl.[6] ..... H01R 43/16

[52] U.S. Cl. ..... 29/874; 29/882; 29/34 R; 72/338; 72/402

[58] Field of Search ..... 29/874, 882, 34 R; 72/338, 402

[56] References Cited

U.S. PATENT DOCUMENTS

| | | | |
|---|---|---|---|
| 3,601,890 | 8/1971 | Pityo et al. | 29/824 |
| 4,836,006 | 6/1989 | Brown | 29/882 X |
| 5,031,305 | 7/1991 | Furrer et al. | 29/882 |
| 5,077,892 | 1/1992 | Nugent | 29/874 |

*Primary Examiner*—Carl J. Arbes

*Attorney, Agent, or Firm*—Renner, Otto, Boisselle, Sklar

[57] ABSTRACT

Elongated generally rectangular in-section conductive metal bar stock is formed by extrusion to form a post type electrical bus connector. The shorter dimension is approximately the diameter of the posts to be formed, while the longer dimension is approximately the height of the posts plus the thickness of the bus or bar from which the posts will project. The narrow end forming the bus has a triangular ridge. The bar stock is cut-to-length dictated by the number of posts to form blocks which are then loaded into specialized pallets of a machining center. The machining center is the type having at lest two pallets, one being loaded while the other is indexed with respect to the tool spindle. The machining center also includes an automatic tool changer. The machining center mills the posts with a hollow center flush mill, drills the hole in the posts and forms tapped holes followed by deburring. The bar stock may have extruded L-shape flats, one of which forms a pad for a compression type connector. In the manufacture of such compression connectors, the drilling of a hole axially of the posts is not required.

16 Claims, 3 Drawing Sheets

METHOD OF MAKING ELECTRICAL CONNECTORS

This invention relates generally as indicated to electrical connectors and a method of making such connectors, and more particularly to high ampacity underground bus type connectors widely used in utility distribution systems, and to an extrusion-machining method of making such connectors.

BACKGROUND OF THE INVENTION

Underground and submersible junction bus connectors are widely used in utility distribution systems. Typical of such connectors are the connectors sold under the trademark ESP® by Eritech, Inc. of Aberdeen, N.C., under the model designations UC, HFS, RD, UCD, BRD, and UCB. Such connectors are commonly characterized by a rigid bar or bus from which projects a plurality of relatively closely spaced circular posts. The thickness of the bar or bus may typically be about one tenth or more the projection of the posts. The number of posts may vary from as few as two to as many as eight or more. Such submersible connectors are widely used in connections to transformers usually underground in electrical power distribution systems.

There are generally two types of such connectors. One employs hollow posts for each terminal or outlet and one or more set screws to clamp and secure the end of the conductor within each hollow post. Another type utilizes a flat pad on the end of an otherwise solid post. One or more compression fasteners secure a conductor lug to the flat pad. The flat pad may extend for approximately the outer two thirds of the post, and the outer end of the pad surface may include an alignment recess interfitting with the conductor lug to maintain lug and post alignment. With such connectors, high amperage connections can quickly be made.

Because of the complex configuration of the connectors which include a lot of non-parallel surfaces, they are typically made by fabrication with weldments or from aluminum alloy castings, all at considerable cost. One of the principal cost problems in casting is that separate molds or dies are required for each model of connector, and within the model for each number of terminals or outlets. Accordingly, the investment in molds and core molds, or dies alone is staggering.

Moreover, the castings have to be made in a job shop foundry or die casting shop which further raises the cost. While some large scale foundries or die casting shops can afford the environmental strictures now required, many smaller foundries or shops can not, and many have closed, requiring importation of castings and/or much higher costs. In addition to higher costs, uncertainty of supply is a problem with castings.

In addition to the economic and environmental problems, castings present some technical problems as well. The surface texture is rather rough which is not ideal for higher amperage electrical connections. They require a considerable amount of grinding or surface finishing after casting and this is usually a manual labor intensive operation. They still require tapping of holes for clamping or set screws, and the casting makes alignment and jigging problems for this more complex and less accurate. Also, the physical properties and microstructure of castings can be less than desirable. For example, an extruded and machined part will have considerably higher mechanical strength, better conductivity, better appearance, and improved surface contact with the conductor or lug.

The extrusion process, particularly hot extrusion, has been widely used to produce a variety of parallel surface shapes including some electrical connectors. Such connectors have relatively simple square, rectangular or other parallel face surface shapes, and secondary machining operations are generally limited to drilling and tapping in such parallel face surfaces. Examples of such extruded connectors are those sold under the trademark ESP® by Eritech, Inc. of Aberdeen, N.C., under the model designations UP, UPSO, UPM, UPT and UPU Using the extrusion process to produce such relatively simply parts results in quality connections which are economical to produce.

It would, accordingly, be desirable to be able to produce the more complex connectors having a lot of non-parallel surfaces by an extrusion-machining process to produce both improved and lower cost connectors.

SUMMARY OF THE INVENTION

The present invention utilizes an extrusion-machining process to form the more complex round post connectors. A generally rectangular in cross section extrudate is formed of a conductive metal alloy such as aluminum. The shorter sectional dimension is approximately the diameter of the posts, while the longer dimension is the height of the posts, plus the thickness of the bus or bar from which the posts will project. One narrow end is provided with a slight center triangular apex or ridge and two sloping symmetrical sides. The slight point or triangular ridge formed will be along the exterior of the bar or bus and facilitates the dip coating of the connector with electrical insulation material without the entrapment of air. If the flat pad form of the connector is formed, the extrudate is in the sectional form of an L, with the extruded interior surface of the long leg of the L forming the pad to which the conductor lug is secured in compression.

After the extrudate is cooled, it is cut to bar stock lengths necessary for storage, bundling or shipment. Lengths of sixteen feet or more can readily be accommodated for shipment.

The conductive metal bar stock is then delivered to a machine shop and cut to the desired length to form cut-to-length blocks, which length is determined by the desired number of posts. The cut-to-length stock is then loaded on a special pallet of a machining center. The machining center includes at least two pallets. One is loaded while the other is being indexed through the machining operations. Each pallet is movable in the X, Y and Z axis and is rotatable about the Z or vertical axis, all at the control of a programmable computer.

The machining center may include a horizontal axis spindle and an automatic tool changer. The special pallets grip the cut to length stock blocks along and on each side of the slightly crowned bus bar side so that the parts are on end with the portion which will form the posts facing radially outwardly. The machining center includes at least four tools.

Although the precise order of the machining operations may vary, the posts or conductor terminals are formed with a special hollow mill and any excess metal removed from between the posts by an ordinary mill. The hollow mill includes an interior pressure flush of coolant to keep chips away from the exterior post surface being formed. The post is formed with a centered or slightly eccentric conductor hole or port. If the conductor port is eccentric, the barrel of the post at the thicker part near its end is formed with one or more set screw holes by drilling and tapping, the pallet being axially rotated so that the part is held at right angles to the spindle.

If a pad type connector is being formed with the L-shape extrudate bar, the conductor port drilled axially in the post is not required. The milling of the post will provide the rounded and axially flatted post, so that one or more threaded holes may be formed directly through the flatted part of the post by the right angle drilling and tapping operation. The alignment recess is also formed in this manner.

The machined bar stock which now has the posts projecting from the slightly crowned unformed solid bar side is deburred. The parts when removed from the pallet are ready for dipping and assembly.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figures 1, 2, 3, 4, 5, 6, 7:
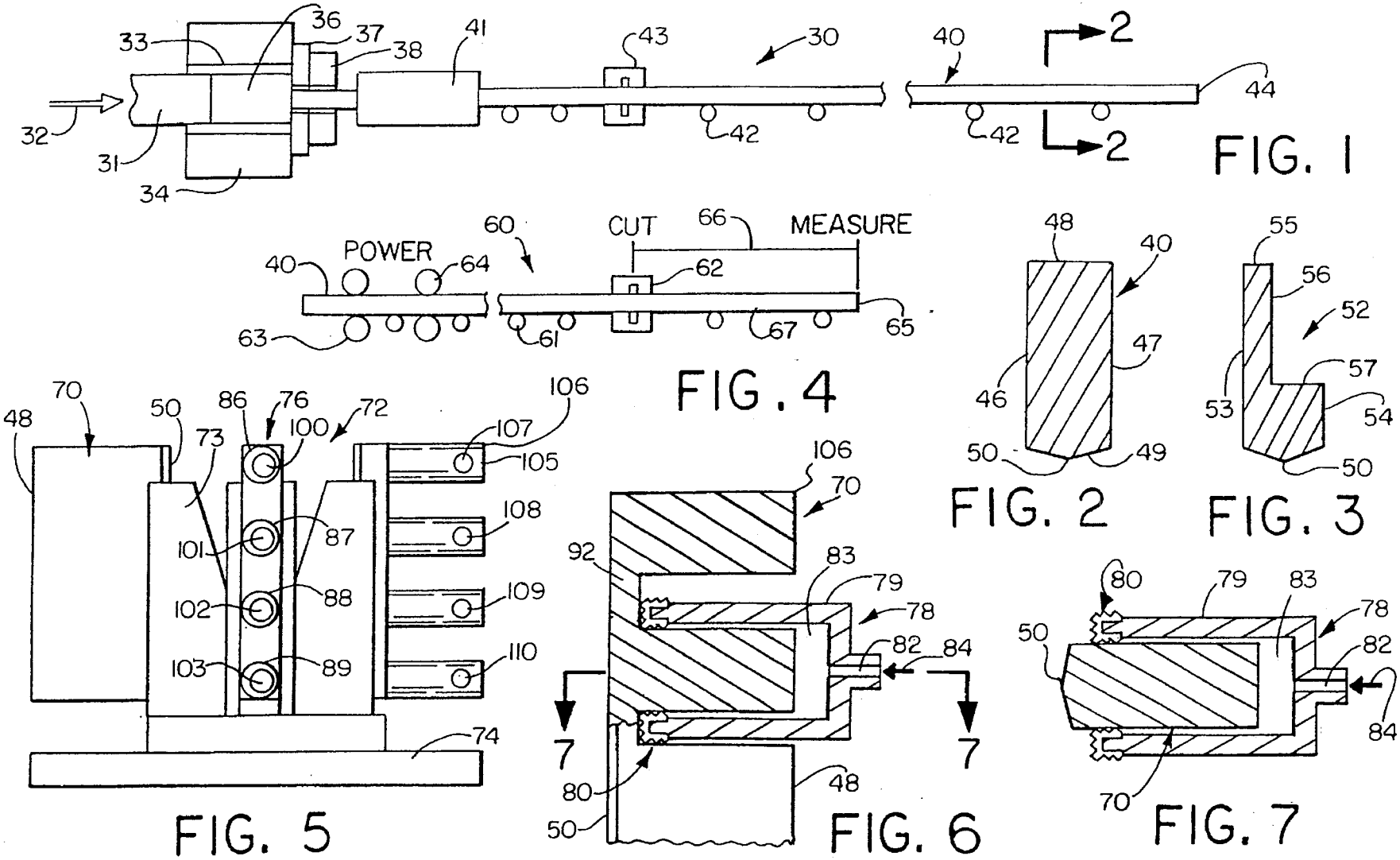
FIG. 1 is a schematic illustration of an extrusion line in accordance with the present invention for forming bar stock.
FIG. 2 is an enlarged transverse section of one form of bar stock connector for making a hollow post connector taken substantially on the line 2—2 of FIG. 1.
FIG. 3 is an enlarged transverse section of another form of bar stock for making a flat pad compression connector.
FIG. 4 is a schematic illustration of a cutoff line where the bar stock lengths of FIG. 1 are measured and cut to selected lengths for machining.
FIG. 5 is an elevation of cut-to-length blocks mounted on a machining center pallet.
FIG. 6 is an illustration partially in section showing a hollow mill forming the posts.
FIG. 7 is a similar view taken from the line 7—7 of FIG. 6.

Referring now to the drawings and initially to FIG. 1, there is illustrated an extrusion line shown generally at 30. The extrusion line at the left hand end as shown includes a high pressure ram 31, being urged in the direction of the arrow 32, and moving within liner 33 of container body 34. The ram is pressing against a hot or heated billet 36, extruding the billet through die 37, held in place by die backer 38.

The extrusion process forms the hot billet into an elongated bar shown generally at 40. The bar passes through a cooler 41 and is supported on rollers or other suitable conveyors indicated at 42, to pass through a cutoff 43. The cutoff 43 is operable in response to the length of extruded stock, passing through the cutoff and it may be actuated by a linear measure or a flag positioned at the cutoff end 44 to cut the extruded stock into bar stock lengths. The length of the bar stock may be determined as a convenience for storage and shipment. Generally, lengths of sixteen (16) feet or more may readily be accommodated for shipment in bundles.

The metal of the billet 36 and the extruded bar stock 40 is a conductive metal and preferably an aluminum alloy.

Referring now to FIG. 2, there is illustrated one form of extruded bar stock in accordance with the present invention. The bar stock is generally rectangular and includes parallel sides 46 and 47 with a flat top or end 48 and a ridged bottom or end 49. The slight triangular ridge indicated at 50 facilitates the dipping of the connector into an insulating material when machined. The connector will be dipped vertically as shown in FIG. 2, and ridge 50 precludes the entrapment of air on the bottom of the connector. The ridge is preferably formed in the extrusion process by the extrusion die.

With reference to FIG. 3, there is illustrated a somewhat modified sectional configuration of the bar stock indicated generally at 52 for forming a flat pad compression connector. The extrusion process produces one long side 53, a shorter side 54, and a relatively narrow top 55, the opposite end or bottom including the triangular ridge 50. Between the narrow top and short side, there is produced an L-shape flat configuration with the long leg 56 of the L extending parallel to the side 53 and the short leg 57 being perpendicular thereto.

With either sectional form illustrated, the bar stock lengths may be bundled and delivered to a machine shop where they are initially passed through a cutoff shown generally at 60 in FIG. 4. The bar stock may be supported on roller conveyor 61 between side guides, not shown, and is moved through the cutoff 62 by suitable paired power rollers 63 and 64. The cutoff is typically a rotating saw and may be a flying saw to move with the stock as it moves to the right in FIG. 4. The length of the bar from the end 65 to the cutoff is carefully measured as indicated at 66 to form an elongated conductive block shown at 67, the length of the block being determined by the number of posts to be formed in the connector. As indicated, the connector may include two, three, or eight or more posts and it is the type of connector being formed which indicates the length of the block being provided by the cutoff.

Referring now to FIG. 5, after the blocks shown generally at 70 are cut to the desired length, they are loaded in a special machining center pallet shown generally at 72. The pallet includes vertically extending clamps indicated at 73 which grip the block 70 along the bottom or ridged edge so that the top or other edge 48 is facing radially outwardly. In the illustrated embodiment, each pallet may accommodate four blocks, each with its top end or edge facing radially outwardly and quadrant spaced. The pallet includes a shuttle table 74 and the entire pallet in the machining center is mounted for indexing movement in the X, Y or Z direction and also for rotation about the vertical or Z axis. In a fixed spindle machining center, the spindle is rotating normal to the plane of FIG. 5. Alternatively, it may be appreciated that the machining center may be of the fixed column type where the spindle may move vertically on a fixed column and the pallet need move only in the X, Y direction, and rotate about the Z axis. The machining center includes an automatic tool changer and is of the type where the pallet has at least two positions, one in proper orientation with respect to the spindle, and the other in position for loading or unloading. Fixed column type machining centers which include a pallet shuttle are available from Cincinnati Millicron Inc., of Cincinnati, Ohio.

When four blocks have been loaded on the special pallet as seen in FIG. 5, a computer program for the number of posts involved and the type of connector is selected.

Referring now to FIGS. 5–11, it will be seen that in the machining station of the machining center the pallet will index the block 90° to the center position facing the viewer indicated at 76, and the first operation may be performed with a special hollow mill such as seen at 78 in FIGS. 6 and 7. The hollow mill includes a cylindrical body 79 having relatively fine cutting teeth 80 on the axial end and projecting slightly from both the interior and exterior of the body. The body at the shank includes an axial port 82 whereby coolant under pressure enters the interior of the mill seen at 83. The coolant flowing in the direction of the arrow 84 enters the interior of the mill body 83 and, under pressure, flushes chips away from the cutting teeth 80 to the exterior of the mill body. The mill mounted for high speed rotation on the machining center spindle quickly forms the exterior of four posts in the outer face 48 of the block as seen at 86, 87, 88 and 89 as seen in FIGS. 5, 6, 10 and 11.

As seen in FIG. 7, the inside diameter of the teeth of the hollow mill is substantially the same as the width of the machining block so that the circular posts formed are tangent to the sides of the block. The hollow mill proceeds to the approximate depth seen in FIGS. 6 and 7 leaving the portion indicated at 92 unmilled, such portion eventually becoming the interconnecting bus or bar which integrally joins the posts and from which the posts project.

Figures 8, 9, 10, 11, 12, 13, 14, 15, 16, 17, 18:
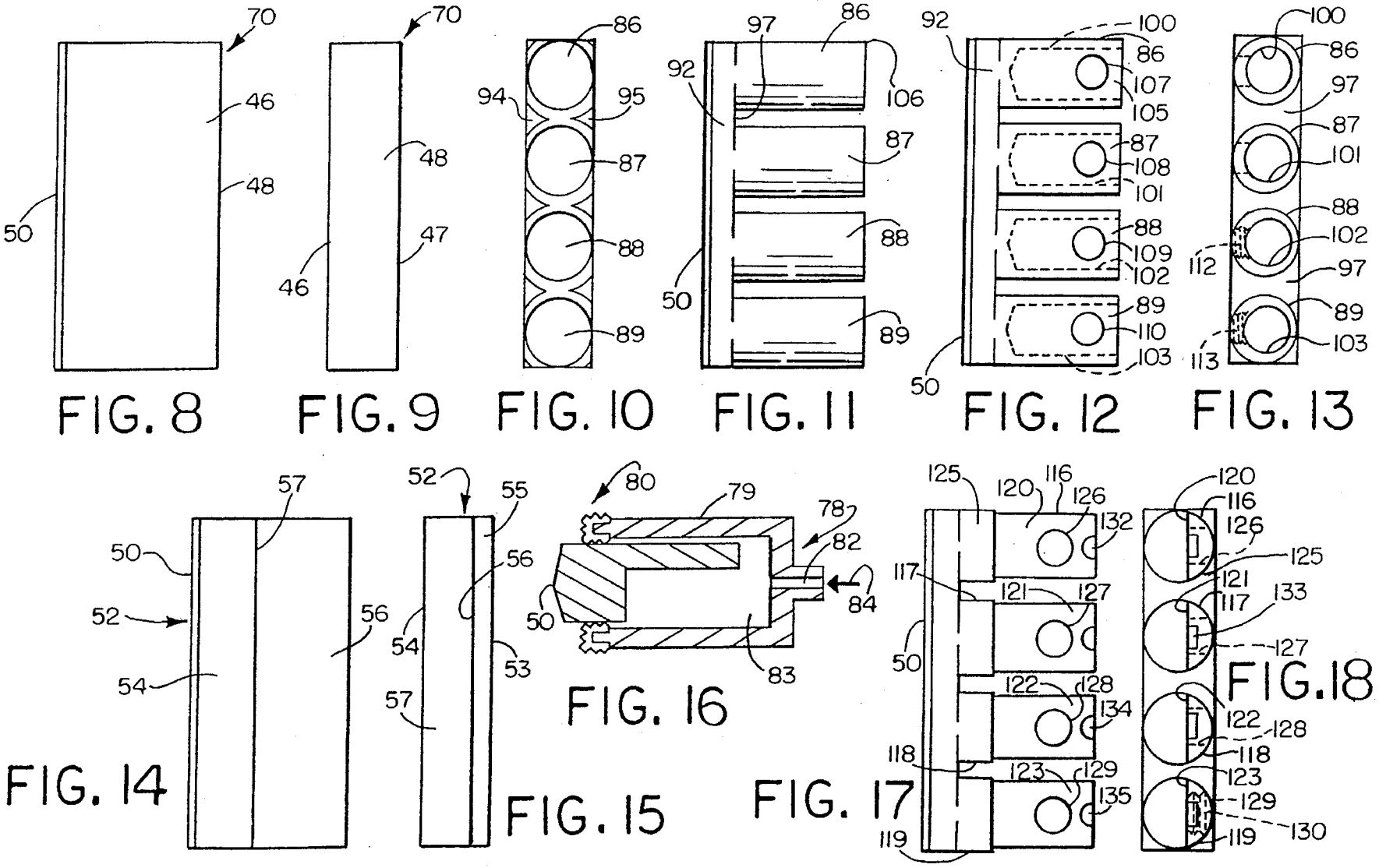
FIGS. 8 and 9 are side and top elevations of the cut-to-length block.
FIG. 10 is a top elevation after the posts have been formed.
FIG. 11 is a side elevation after excess metal has been removed from between the posts.
FIG. 12 is a side elevation after the conductor ports have been drilled and showing the drilling and tapping of the set screw holes.
FIG. 13 is a top elevation as seen from the right hand side of FIG. 12.
FIGS. 14 and 15 are side and top views of a flat pad cut-to-length block.
FIG. 16 is the illustration like FIG. 7 of the flat pad post being formed.
FIGS. 17 and 18 are views like FIGS. 12 and 13 of the clamp screw hole drilling and tapping.

Referring now to FIGS. 10 and 11, it will be seen that the hollow mill operation produces relatively small triangular or cusp-like projections indicated at 94 and 95 which are removed by the next machining operation utilizing a relatively small conventional mill. The pallet may move the work during the excess milling operation so that the mill removes all of the unwanted excess metal from between the exterior of the posts. The mill is preferably small enough to move directly between the posts, not only removing the excess metal, but providing the adjoining surface of the connecting bar 92 with a fine milled finish. This surface is shown at 97 in FIGS. 11 and 13, for example.

After the exterior of the post is formed as seen in FIG. 11, the next operation indexes the pallet a relatively short offset distance horizontally to drill in the posts blind holes indicated at 100, 101, 102, and 103 as seen in FIGS. 5, 12 and 13. The slight distance of the offset makes the axis of the holes eccentric with the axis of the barrel wall, providing a thicker wall portion seen at 105, facing the viewer in FIG. 12, and on the right hand side of FIG. 5. Either concurrently with the hollow mill or blind hole drilling, or as a separate operation, the relatively sharp outer corner of the post indicated at 106 may be chamfered.

After such blind conductor holes are drilled, the pallet is rotated about its vertical axis and indexed again to the axis of the spindle so that the machining center in such right hand position seen in FIG. 5 may initially drill the holes seen at 107, 108, 109, and 110. In such position, the drilling operation is followed by a tapping operation to produce the internal threads on the holes, such as seen at 112 and 113 in FIG. 13. After the tapped holes are deburred, the machining center has completed its operation on the block and when all blocks on the pallet have been thus completed, the pallet returns to the loading and unloading position. When the finished part is removed, after cleaning, it is ready for dipping and assembly.

Referring now to FIGS. 14–18, it will be seen that the extrusion profile seen in FIG. 3 may be machined in the machining center in essentially the same manner, but need not include the blind hole in the post. The cut-to-length block as seen in FIGS. 14 and 15 is oriented in the manner illustrated on the machining center pallet with the top or that portion seen in FIG. 15 facing radially outwardly. Coolant under pressure through the passage 82 as seen in FIG. 16 forces the chips away from the exterior of the posts being formed. Any unwanted metal between the posts is removed in the same manner by the secondary conventional milling operation.

After the posts are formed, they appear as indicated at 116, 117, 118, and 119 in FIGS. 17 and 18. The extruded surface 56 in the bar stock forms the flat pads 120, 121, 122 and 123 on such posts, respectively. The flat pads appear slightly more narrow than the outside diameter of the base of the posts because the extruded surface 56 is slightly off center as seen in FIGS. 3, 15, 16, and 18. The flat pad extends for approximately ⅔ to ¾ the overall projection of the posts from the unmilled bus or bar 125.

After the posts are formed with the flat pad during the hollow mill and milling operations, the pallet is rotated 90° to position the blocks on the right hand side as seen in FIG. 5 which positions the flat pads 120–123 normal to the machining center spindle axis.

The machining center then drills the holes seen at 126, 127, 128, and 129 in FIG. 17, followed by tapping of such holes to form the threads seen at 130 in FIG. 18.

When in such position normal to the spindle, the pallet is again indexed to the left as seen in FIG. 5, to bring the spindle in line with the tip of the post and utilizing a suitable mill or drill, an indentation is formed in the end of each post as seen at 132, 133, 134, and 135. This indentation interlocks with a projection on the underside of a lug which is fastened in compression to the flat pad surface to maintain the conductor lug and post in alignment.

With reference to FIGS. 12 and 17, it will be appreciated that the pallet may be indexed right or left in FIG. 5 after the initial drilling and tapping operation so that two set screw holes are formed in the hollow post connector of FIG. 12, or two clamping fastener holes are formed in the flat pad compression connection of FIGS. 17 or 18.

Again, after deburring, the pallet returns to the loading and unloading station and the machined parts may be removed from the pallet and, after cleaning, are ready for dipping and assembly.

Figures 19, 20, 21, 22:
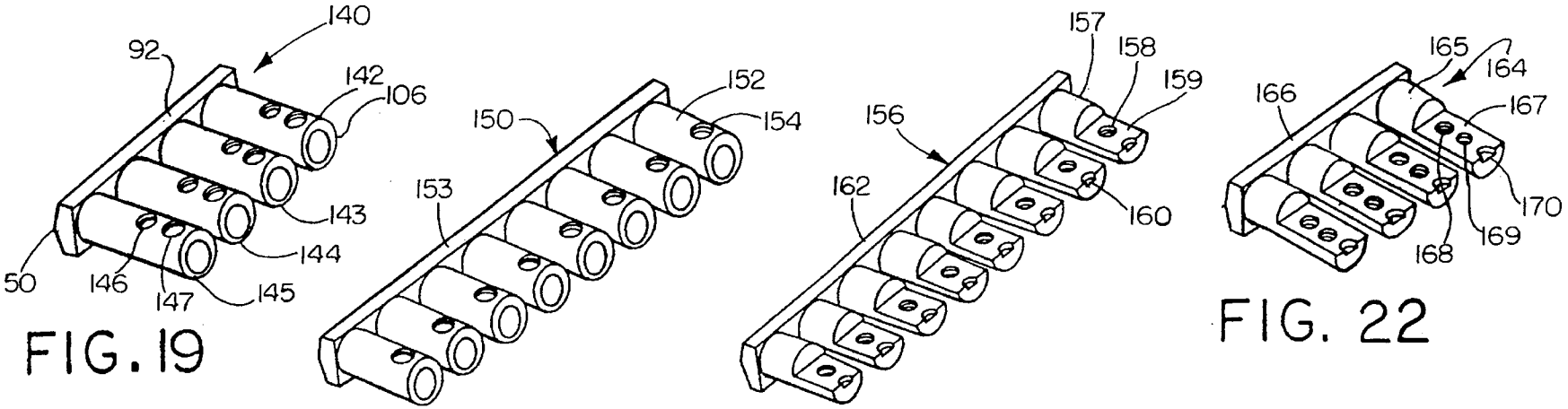
FIGS. 19 and 20 are isometric illustrations of two forms of hollow post connections made with the process of the invention.
FIGS. 21 and 22 are similar views of two forms of flat pad connectors made with the process of the invention.

Referring now to FIGS. 19–22, there is illustrated four different types of connectors which may be made in accordance with the present invention. In FIG. 19, there is illustrated a four post set screw connector shown generally at 140 which includes four side-by-side hollow posts 142, 143, 144, and 145, each of which has two set screw holes seen at 146 and 147. The tapped holes are formed in the thickest wall portion of the barrel formed by the drilling of the posts, and it will be seen that a conductor may readily be inserted into the posts and clamped tightly in place by set screws in the tapped holes.

FIG. 20 illustrates another form of connector shown generally at 150 with eight hollow posts 152, projecting side-by-side from the bus or bar 153, each post having a single tapped hole 154 in the thickest portion of the barrel wall.

FIG. 21 illustrates an eight post flat pad connector 156 with each post 157 having a single tapped hole 158 in the flat pad 159 thereof. The tips of each post at the flat pad are provided with indentations 160 to align the conductor lug with the post when clamped thereto under pressure. Each of the posts projects from and is formed integrally with the bus or bar 162.

In FIG. 2, there is illustrated a four post pressure pad connector indicated generally at 164, having four posts 165 projecting from the bus or bar 166. Each pad surface 167 is provided with two axially aligned tapped holes seen at 168 and 169, and the tip of such pad is provided with the interfitting indentation 170. It will be appreciated that a wide variety of similar connectors may be manufactured in the same manner.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

What is claimed is:

1. A method of making electrical connectors of the type having a bus bar interconnecting a plurality of posts projecting from the bar with means to secure a conductor to the posts, comprising the steps of extruding an elongate generally rectangular bar stock profile having a long transverse dimension substantially equal to the projection of the posts and thickness of the bar, and having a width substantially equal to the diameter of the posts and width of the bar, cutting the bar stock to length to form blocks suitable for making a connector with a selected number of posts, placing a number of such cut-to-length blocks on a pallet of a machining center, said machining center including a programmably movable pallet and a tool changer, indexing the pallet to cause the machining center to form posts in said block, said posts being formed with a hollow mill, and drilling and tapping fastener holes on said posts to secure conductors thereto.

2. A method as set forth in claim 1 including the step of drilling holes axially in said posts to form a post barrel having a conductor receiving hole, and drilling and tapping set screw holes in the post barrel.

3. A method as set forth in claim 2 including the step of rotating the pallet 90° to position the post barrel for such drilling and tapping.

4. A method as set forth in claim 3 including the step of drilling and tapping at least two holes in each barrel.

5. A method as set forth in claim 2 including the step of drilling holes axially of said post eccentrically of the axis of the post to form a section of larger wall thickness in the barrel.

6. A method as set forth in claim 5 including the step of indexing the pallet slightly to drill such eccentric holes.

7. A method as set forth in claim 6 including the step of indexing the pallet rotationally to place the posts normal to the spindle and with the thickest part of the post barrel facing the spindle.

8. A method as set forth in claim 1 including the step of forming one narrow end of the transverse dimension of the bar with a triangular ridge, and forming the posts to extend away from said narrow end.

9. A method as set forth in claim 1 including the step of forming the exterior of said posts with a hollow mill, said mill having teeth on the end, interior and exterior of the mill.

10. A method as set forth in claim 9 including a center coolant flush for said mill operative to flush chips from the mill away from the post exterior surface being formed.

11. A method as set forth in claim 1 including the step of forming an L-shape recess in the extrusion to form an axial flat on each post when formed.

12. A method as set forth in claim 11 including the step of rotating the pallet 90° after the posts are formed to drill and tap a clamp fastener hole in each said flat.

13. A method as set forth in claim 12 including the step of drilling and tapping a second clamp fastener hole in each said flat.

14. A method as set forth in claim 13 including the step of forming an indentation in the axial outer end of each said flat.

15. A method as set forth in claim 11 including the step of forming the exterior of said posts with a hollow mill, said mill having teeth on the end, interior and exterior of the mill.

16. A method as set forth in claim 15 including the step of using a center coolant flush for said mill operative to flush chips from the mill away from the post exterior surface being formed.

* * * * *